US008104152B2

(12) United States Patent
Spiers

(10) Patent No.: US 8,104,152 B2
(45) Date of Patent: Jan. 31, 2012

(54) TRAY FOR COLLECTING AND/OR TREATING DECOMPOSITION FLUIDS FROM A CORPSE

(76) Inventor: David Spiers, Newtownards (IE)

( * ) Notice: Subject to any disclaimer, the term of this patent is extended or adjusted under 35 U.S.C. 154(b) by 208 days.

(21) Appl. No.: 12/496,775

(22) Filed: Jul. 2, 2009

(65) Prior Publication Data

US 2011/0000058 A1 Jan. 6, 2011

(30) Foreign Application Priority Data

Jul. 4, 2008 (GB) ..... 0812273.1

(51) Int. Cl.
*A61G 17/00* (2006.01)

(52) U.S. Cl. ..... 27/19; 27/27

(58) Field of Classification Search ..... 27/11, 19, 27/27; 211/85.16; 5/606; 269/13; 108/24; 206/557

See application file for complete search history.

(56) References Cited

U.S. PATENT DOCUMENTS

| | | | | | |
|---|---|---|---|---|---|
| 2,022,591 | A | * | 11/1935 | Everitt | 312/229 |
| 2,022,714 | A | * | 12/1935 | Gallup | 5/620 |
| D306,100 | S | * | 2/1990 | Wende | D6/398 |
| 5,092,020 | A | * | 3/1992 | MaGuire | 27/19 |
| 5,444,900 | A | * | 8/1995 | Shawhan et al. | 27/19 |
| 5,615,464 | A | * | 4/1997 | Rojdev | 27/19 |
| 7,073,464 | B2 | * | 7/2006 | Keil | 119/753 |
| 7,197,794 | B2 | * | 4/2007 | Davis et al. | 27/19 |
| 7,322,079 | B2 | * | 1/2008 | Davis et al. | 27/19 |
| 7,458,138 | B2 | * | 12/2008 | Spiers et al. | 27/29 |
| 7,581,293 | B1 | * | 9/2009 | Allen | 27/19 |
| 2009/0056595 | A1 | * | 3/2009 | Dean et al. | 108/24 |

* cited by examiner

*Primary Examiner* — William L. Miller

(74) *Attorney, Agent, or Firm* — Sullivan & Worcester LLP; Christopher T. McWhinney

(57) ABSTRACT

A tray comprising a hollow body for placement within or beneath a coffin for collecting and/or treating decomposition fluids from a corpse within said hollow body, wherein said tray comprises an upper wall and a lower wall defining at least one closed chamber therebetween, said upper wall being provided with at least one drainage aperture in an upper surface through which fluid collected on said outer surface of the upper wall can pass into said at least one closed chamber to be retained and/or treated therein.

21 Claims, 6 Drawing Sheets

TRAY FOR COLLECTING AND/OR TREATING DECOMPOSITION FLUIDS FROM A CORPSE

BACKGROUND OF THE INVENTION

1. Field of the Invention

The present invention relates to a tray for collecting and/or treating decomposition fluids from a corpse and in particular to a tray for collecting and neutralising decomposition fluids from a corpse to prevent contamination of the environment.

2. Description of Related Art

It is common for dead bodies to be placed in ceremonial coffins to be buried in burial grounds or placed in mausoleums. Over time, the bodies decompose and fluids from the decomposing body may leach out of the coffin, which itself will degrade over time, and contaminate the surrounding soil and ground water and possibly extend to nearby water courses. A further environmental problem results from the use of toxic formaldehyde embalming fluids. While less toxic than previously used arsenic based embalming fluid, formaldehyde embalming fluid nonetheless is a pollutant and a known carcinogen and a strong reducing agent.

Often burial vaults comprising underground concrete chambers, are used to ensure that graves do not collapse. More recently sealed plastic burial vaults have been used to enclose coffins, such vaults incorporating means to prevent the leakage of fluids therefrom. However, such arrangements are prone to failure and may flood, increasing the risk of contamination.

More recently, due to increasing population density and pressure on land usage, land suitable for use as a burial ground has become increasingly hard to find. There is therefore a need to bury bodies more closely together, possibly burying several bodies in a single mass grave. It is also often desired to bury additional family members at the site of an existing grave.

A grave lining system to allow a plurality of coffins to be located in a single grave is disclosed in EP 1 783 303. While this provides significant advantages in terms of land usage for burial grounds, the greater number of bodies in a given area of ground increases the risk of soil and groundwater contamination. An object of the present invention is to mitigate this risk of contamination by effectively collecting and neutralising fluids resulting from the decomposition of bodies.

According to the present invention there is provided a tray comprising a hollow body for placement within or beneath a coffin for collecting and/or treating decomposition fluids from a corpse within said hollow body, wherein said tray comprises an upper wall and a lower wall defining at least one closed chamber therebetween, said upper wall being provided with at least one drainage aperture in an upper surface through which fluid collected on said outer surface of the upper wall can pass into said at least one closed chamber to be retained and/or treated therein.

Preferably said tray is substantially rectangular in shape. However, the tray may be formed in any other suitable shaped, for example square or oval, as required.

One or more reinforcing ribs may be provided extending between the upper and lower walls to strengthen the tray. Preferably at least one of said reinforcing ribs divides the interior of the tray into two or more closed chambers, each chamber being communication with at least one drainage aperture in the upper wall of the tray.

The at least one chamber may be formed to define a convoluted channel or passageway through which fluids entering said chamber are constrained to flow.

Preferably a raised lip is provided around or adjacent a peripheral edge of the upper surface of the tray to assist the collection of fluid thereon. Preferably the upper surface of the tray slopes downwardly from a peripheral region towards at least one collection region to guide fluids towards the at least one drainage aperture. The at least one drainage aperture is preferably provided at a lowermost point of said at least one collection region. Preferably the upper surface of the tray is convex in shape to guide fluids towards the at least one drainage aperture in said collection region, said collection region being provided in a central region of the upper surface.

At least two or more closed chambers may be defined within said tray, at least one separate drainage aperture being associated with each chamber. The upper surface of the tray may be formed such that the separate drainage apertures are provided at different heights.

Preferably the at least one said closed chamber contains at least one neutralising and/or treatment agent for neutralising and/or treating said fluids. The tray may contain an absorbent material, such as an open cell foam, in a lower region thereof for retaining said at least one neutralising and/or treatment agent. The at least one neutralising and/or treatment agent may comprise at least one of a fluid capable of neutralising formaldehyde embalming fluid, such as ammonia. Said at least one neutralising and/or treatment agent may comprise at least one of an anti-bacterial and/or a disinfectant agent and/or an agent for promoting anaerobic digestion. Where said tray comprises two or more chambers, each of said two or more chambers may contain a separate neutralising and/or treatment agent.

Preferably said at least one drainage aperture is provided with a non-return and/or float valve to allow fluid to pass into said closed chamber but prevent fluids and/or gases from escaping from said closed chamber through said drainage aperture.

Said at least one drainage aperture may be provided with a strainer or mesh for preventing solids from entering the at least one chamber. Said strainer or mesh may be coated or impregnated with an anti-microbial agent. Said anti-microbial agent may comprise colloidal/nano-silver.

A pressure relief valve may be provided for venting gases from said closed chamber when the gas pressure within the closed chamber exceeds the ambient pressure by more than a predetermined amount.

A membrane may be provided between said upper and lower walls to divide the interior of the tray into an upper region and a lower region, said membrane being adapted to filter biological solids from the collected fluids to retain said biological solids in said upper region while allowing liquids to pass into the lower region. Preferably said filter membrane is provided with an anti-bacterial agent.

SUMMARY OF THE INVENTION

In one embodiment, the tray comprises a substantially planar hollow body adapted to support a coffin upon said upper surface thereof. The upper surface of the tray may be provided with locating formations for locating a coffin thereon. Said locating formations may include fastening means for securing a coffin to the tray. Said fastening means may comprise locking means.

Apertures, slots or handles may be provided on the tray, preferably at or adjacent side regions of the tray, for receiving lifting straps to permit the tray, and a coffin located thereon, to be lowered into a grave.

In a further embodiment, the tray is dimensioned to fit within the lower region of a coffin. Alternatively the tray may form the base of a coffin. The tray may comprise the base member of a burial vault. Alternatively a non-biodegradable polymeric cover may be attachable to the base for enclosing a coffin upon the tray.

The tray may incorporate heating means for raising or controlling the temperature within the tray. Such heating means may comprise one or more elongate rods formed from a thermally conductive material, such as a metal, for example copper, extending through the tray to be connectable to a heat source, for example a geothermal heat source.

Alternatively said heating means may comprise one or more electrical heating elements connectable to a source of electricity, for example a battery, photovoltaic/solar cells, or a wind turbine. In an alternative embodiment said heating means may comprise one or more conduits extending through said tray containing a heat transfer medium, said one or more conduits being connectable to a heat source. The tray may incorporate temperature sensing means for controlling said heating means.

Preferably the tray is formed from a water resistant material, more preferably a water impermeable material such as a polymer or metal or the like or a suitable composite material, such as glass fibre reinforced resin. Preferably the tray is formed from an upper moulding and a lower moulding joined together along peripheral edges thereof.

The tray may be provided with formations to enable it to be used as a divider in the grave lining system disclosed in EP 1 783 303. Said formations may comprise tongues or grooves provided around the periphery of the tray to be receivable within cooperating grooves or tongues provided in the side walls of the grave lining system. Electrical and heating conduits may extend through the risers of the grave lining system to connect to corresponding heating means within the tray.

BRIEF DESCRIPTION OF THE FIGURES

An embodiment of the present invention will now be described, by way of example only, with reference to the accompanying drawings, in which.

DETAILED DESCRIPTION OF THE INVENTION

Figure 1:
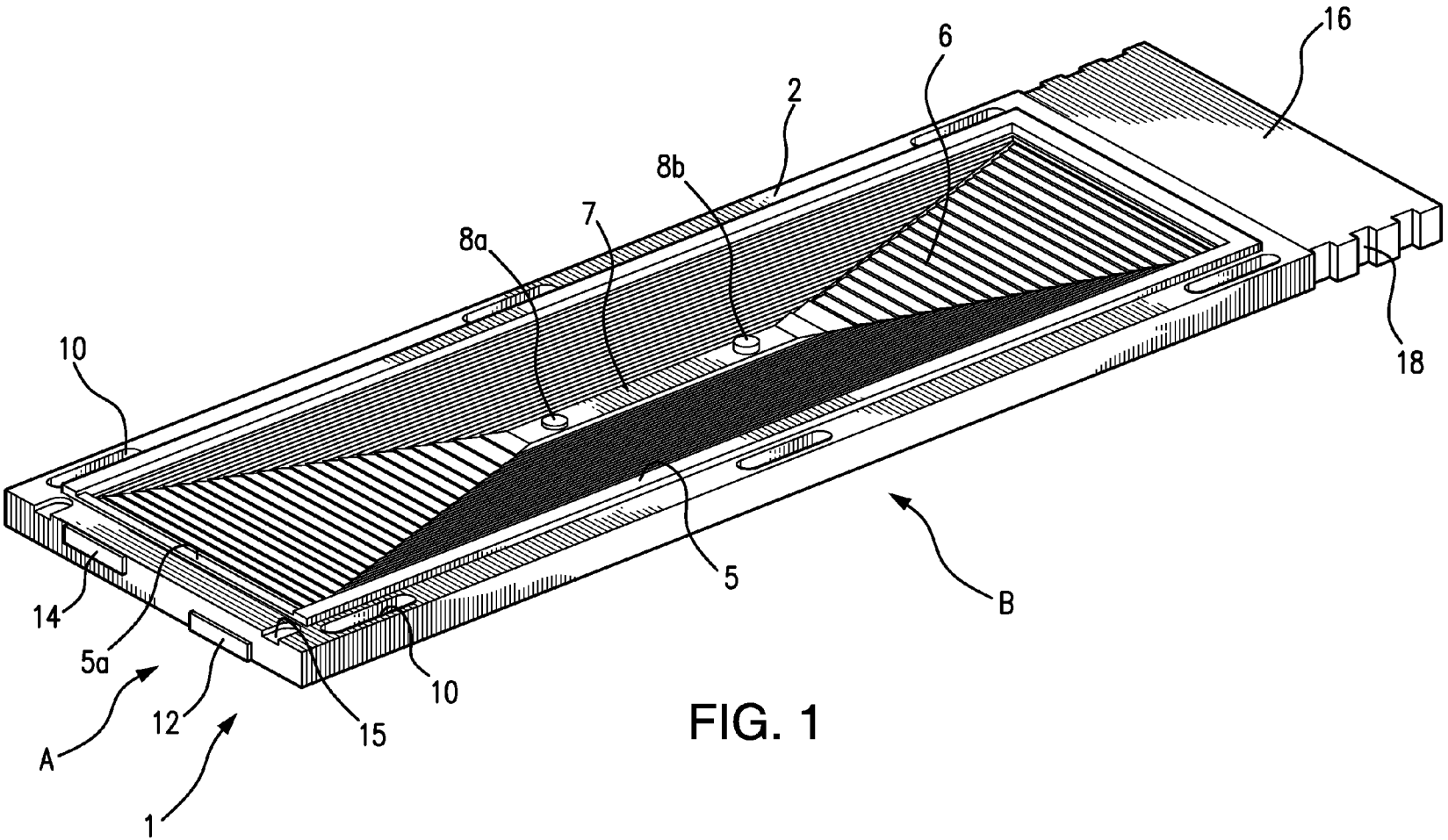
FIG. 1 is a perspective view of the upper side of a tray according to an embodiment of the present invention.
Figure 2:
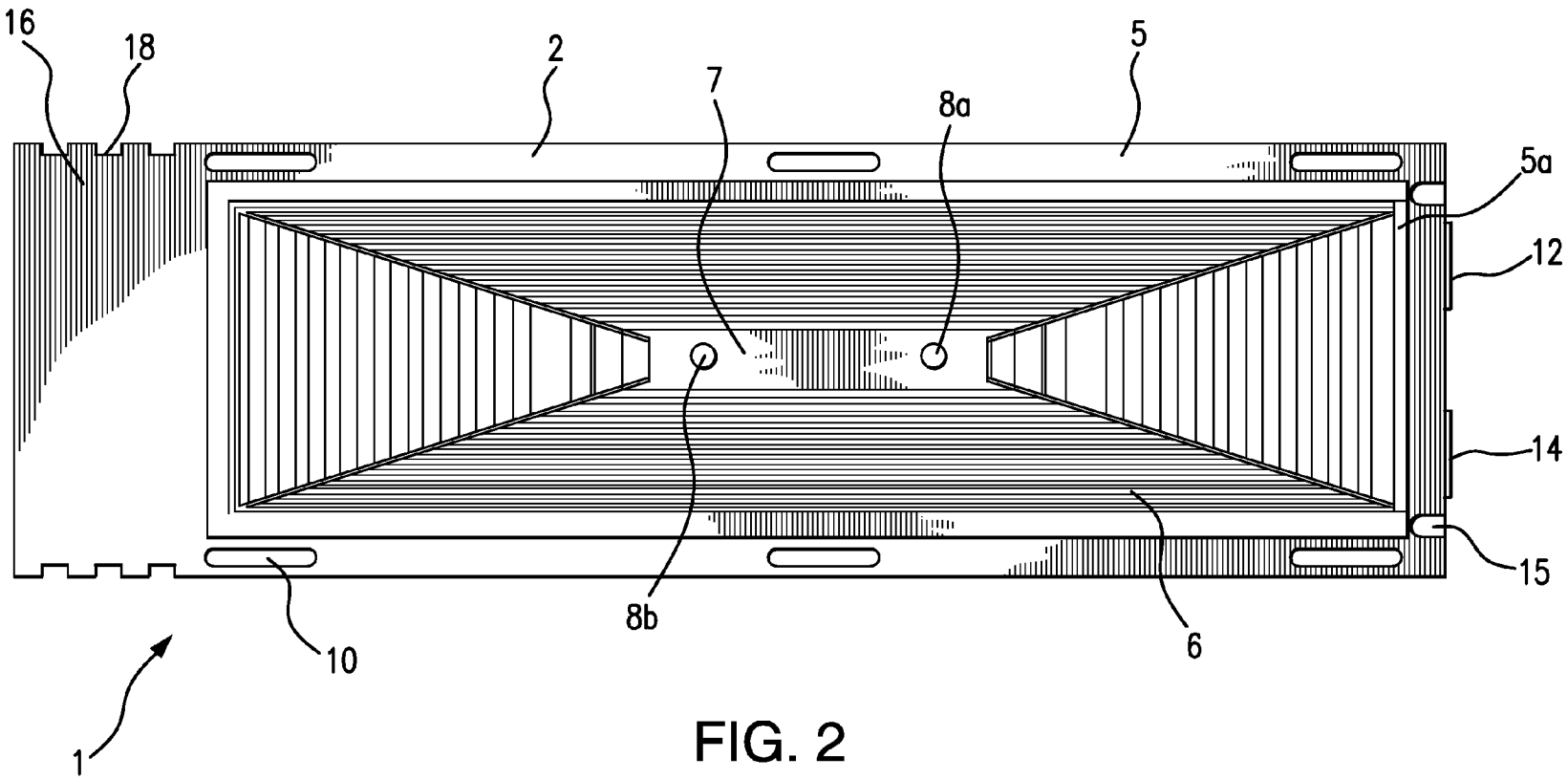
FIG. 2 is a plan view of the upper side of the tray of FIG. 1.

As illustrated in the drawings, a tray 1 for collecting and neutralising decomposition fluids from a corpse comprises an upper section 2 and a lower section 4, joined together around peripheral mating edges thereof to define a hollow body for supporting a coffin.

A raised lip 5, preferably around 10 mm in height, is provided around or adjacent a peripheral edge of an upper surface 6 of the tray 1 to assist the collection of fluid thereon. A reduced height section 5*a* of the lip, for example 5 mm, may be provided at one end of the tray 1 to provide a preferential overflow region said one end of the tray so that a collection basin may be attached to the tray of located beneath said one end to receive fluid in the event of overfilling of the tray 1. An outer edge of the tray 1, outside of said lip 5, may slope downwardly to assist drainage.

The upper surface 6 of the tray 1 slopes downwardly from the raised lip 5 towards a central collection region 7 to guide fluids towards the collection region 7. The sloping or convex upper surface 6 of the tray 1 is stepped or provided with transverse ribs acting as weirs which may collect silt and solid lumps from the fluids, thus refining the fluids as they move towards the collection region 7 of the tray 1.

At least one neutralising or treatment agent, preferably comprising a disinfectant and a chemical suitable for neutralising formaldehyde based embalming fluids, is contained within one or more chambers defined within the tray. A sponge material, such as open cell polymeric foam, is provided in the lower region of the one or more hollow chambers, said sponge material being impregnated with said neutralising and/or treatment agent for neutralising and/or otherwise treating fluid that may be collected within the tray. A suitable agent may be "FORMALDEGONE", a formaldehyde fume suppressant comprising an Isopropanol solution, supplied by The Dodge Chemical Company. Other neutralising and/or treatment agents may comprise anti-bacterial and/or a disinfectant agents and/or agents for promoting anaerobic digestion. Where said tray comprises two or more chambers, each of said two or more chambers may contain a separate neutralising and/or treatment agent A pair of drainage apertures 8*a*,8*b* are provided in said central collection region whereby any fluids draining out of the coffin onto the tray 1 will pass through the drainage apertures 8*a*,8*b* into respective hollow chambers defined with the tray to be retained therein.

Reinforcing ribs may (not shown) extend between the upper and lower sections of the tray to provide strength and to allow the tray 1 to support a coffin without crushing the tray. At least one of the reinforcing ribs, preferably a central transversely extending rib, may divide the interior of the tray into two separate chamber, each chamber communicating with a respective one of the drainage apertures 8*a*,8*b*. The tray may be divided into any number of chambers, each having a respective aperture.

Each drainage aperture 8*s*,8*b* is provided with a non-return or float valve to allow fluids to pass from the upper surface 6 of the tray 1 through the respective drainage aperture 8*a*,8*b*, while preventing gases and liquids from escaping out of said hollow chamber. The valve may comprise a buoyant closure member which will close the valve when the chamber communicating with the respective drainage apertures 8*a*,8*b* becomes full. A pressure relief valve is provided for allowing gases to escape from the hollow chamber if the pressure within the chamber becomes excessive.

Each drainage aperture 8*a*,8*b* may be provided with a strainer or mesh for preventing solids from entering the at least one chamber. Said strainer or mesh may be coated or impregnated with an anti-microbial agent. Said anti-microbial agent may comprise colloidal/nano-silver.

The drainage apertures 8*a*,8*b* may be provided at different heights. For example, a first drainage aperture 8*a* may be provided at a lower level than the second drainage aperture 8*b* so that fluids are initially preferentially drained into a first chamber within the tray via said first drainage aperture until said first chamber becomes filled and its valve closes whereupon further fluid will preferentially pass into the second chamber via said second drainage aperture 8*b*. Thus the first fluids collected, which will largely comprise formaldehyde embalming fluids, will be preferentially collected in the first chamber and later collected fluids, which will largely comprise biological material, will be preferentially collected in the second chamber. This allows different types of fluid to be separately collected in different chamber wherein they may be treated by appropriate neutralising and/or treatment agents selected to neutralise or treat the particular fluids collected.

A filter membrane is provided between the upper and lower sections of the tray to divide the hollow chamber within the tray into a lower region, containing said neutralising agent, and an upper region. The filter membrane allows liquids to pass into the lower region of the chamber while retaining organic solids on the membrane. The membrane may be impregnated or coated with an anti-bacterial agent. Alternatively a filter membrane may be provided at other locations within the or each chamber within the tray to separate solids from liquids at appropriate locations within the tray.

The or each chamber defined within the tray may be provided with raised formations or ribs such that the chamber defines a convoluted path or passageway through which fluids pass. Different regions of the thus defines passageway may be provided with different neutralising or treatment agents to treat different components of the fluids as they pass through the passageway such that the fluids can be treated differently at different stages of decomposition.

Slot like apertures 10 are provided along opposite sides of the tray for receiving lifting straps to allow the tray 1, having a coffin supported thereon, to be lowered into a grave or a burial chamber.

A drain opening may be provided in a lower region of the tray to allow treated fluid to escape from the tray once they have been suitably neutralised and filtered. In the embodiment shown, a knock out section 12 of the tray is provided which may be removed to provided a drain outlet from the tray 1. A further knock out drain 14 is provided on the end of the tray at a higher level than the first knock out section 12, which may be selectively removed to provide a drain at a higher level while retaining a fluids collection sump within the tray 1.

Heat conducting copper rods (not shown) may extend through side or end wall regions of the tray 1 to extend within the lower region of the hollow chamber, said rods being adapted to be placed in contact with a source of heat, for example geothermal heat, to raise the temperature within the hollow chamber to improve the effectiveness of the neutralising agent contained therein. Alternatively the hollow chamber may be provided with electrical heating means. Recesses 15 may be provided at one end of the tray 1 for exposing electrical contacts for the heating means. Such recesses or openings 15 may alternatively or additionally be used for passing heating tubes into the tray or for attachment of an additional sump tank or to serve as locking facilities for connecting the tray to other components of a grave lining system.

The tray 1 may be used to form a base or divider within a burial chamber for supporting a coffin therein or may be used to support a coffin in a mausoleum. Alternatively the tray 1 may be located within a coffin to support a body located therein. The tray 1 preferably includes locking formations on the upper section thereof for locating and securing a coffin thereon. The locking formations may be provided on the upper surface or the sides of the tray. An end 16 of the tray may define a solid section that can be cut to allow the tray 1 o be cut to length to fit into a coffin. The end 16 may be provided with ribs or cutouts 18 to acts as guides for cutting off section of the end 16.

The upper and lower sections 2,4 of the tray 1 may be moulded from a non-biodegradable polymeric material or a composite material, such as glass fibre reinforced resin, the upper and lower sections 2,4 being joined together along their peripheral mating edges by welding or a suitable adhesive. Alternatively the upper and lower sections 2,4 may comprise pressed steel sheets that may be welded or otherwise joined together along peripheral mating surfaces.

Figure 3:
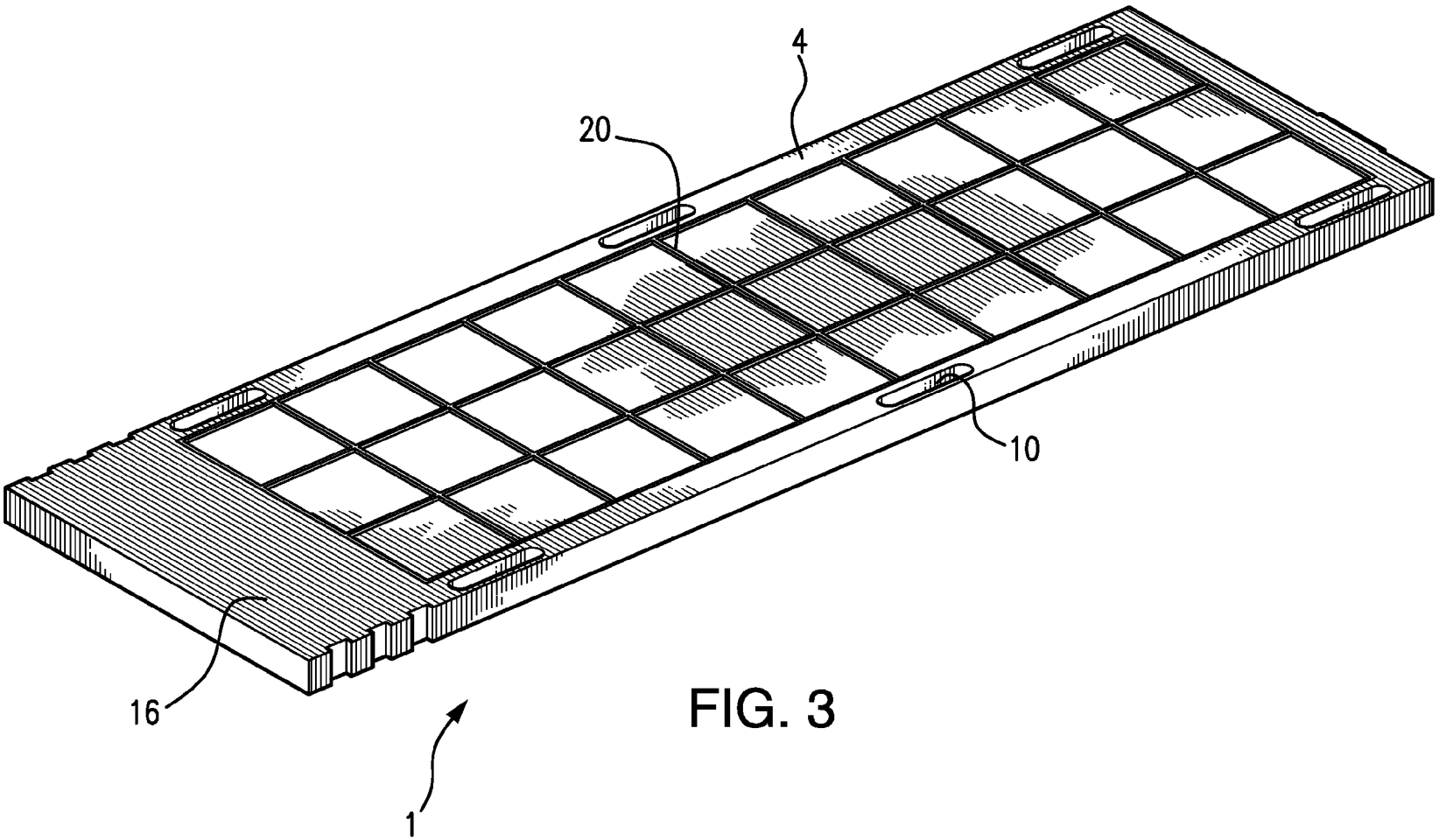
FIG. 3 is a perspective view of the lower side of the tray of FIG. 1.
Figure 4:
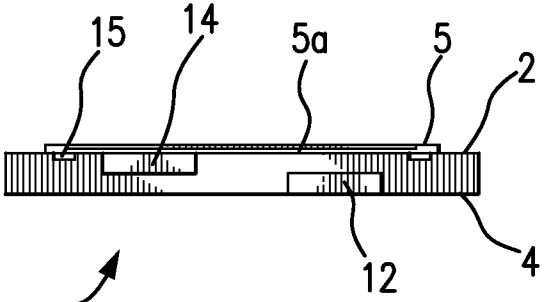
FIG. 4 is an end view of the tray of FIG. 1 in direction A.
Figure 5:
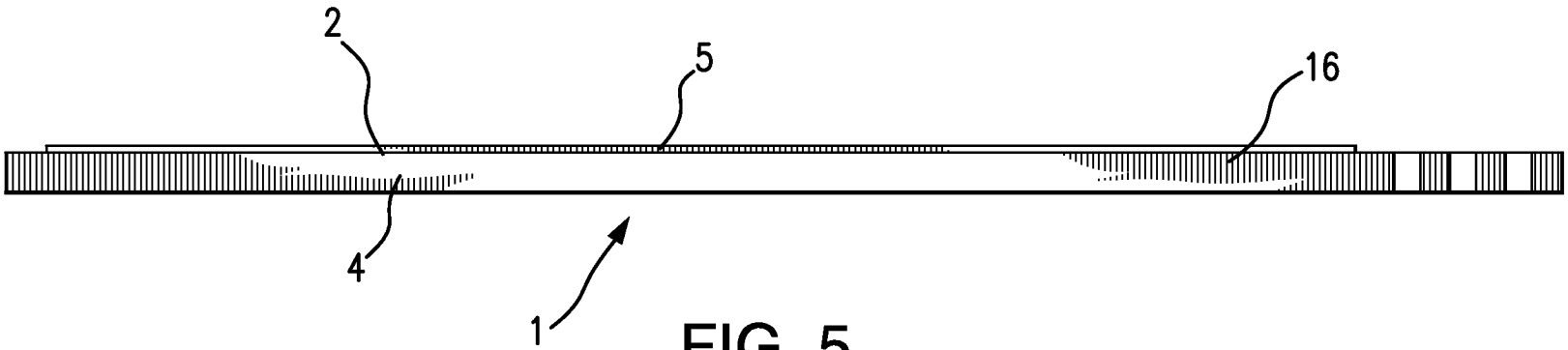
FIG. 5 is a side view of the tray of FIG. 1 in direction B.
Figure 6:
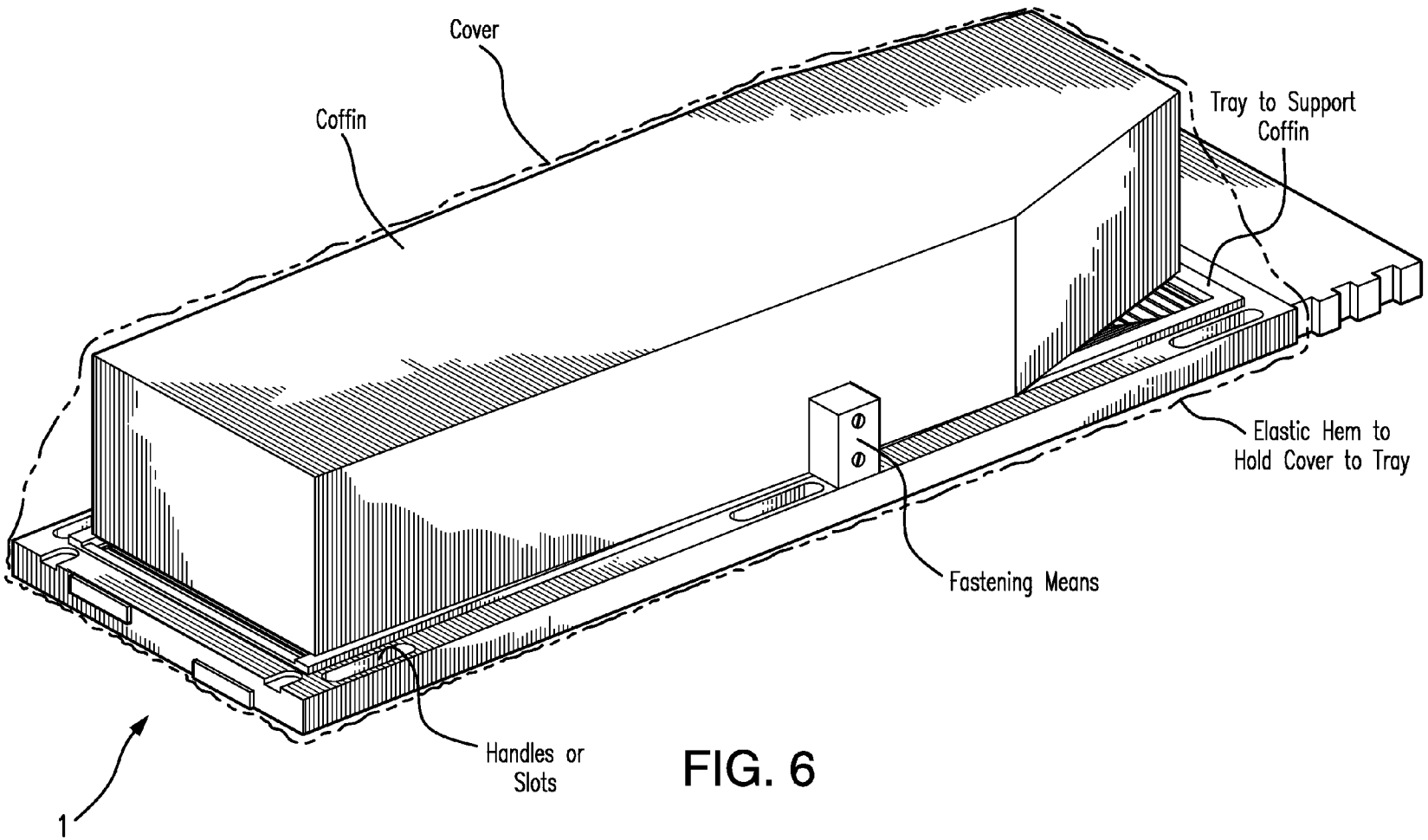
FIG. 6 shows an embodiment of the present invention.
Figure 7:
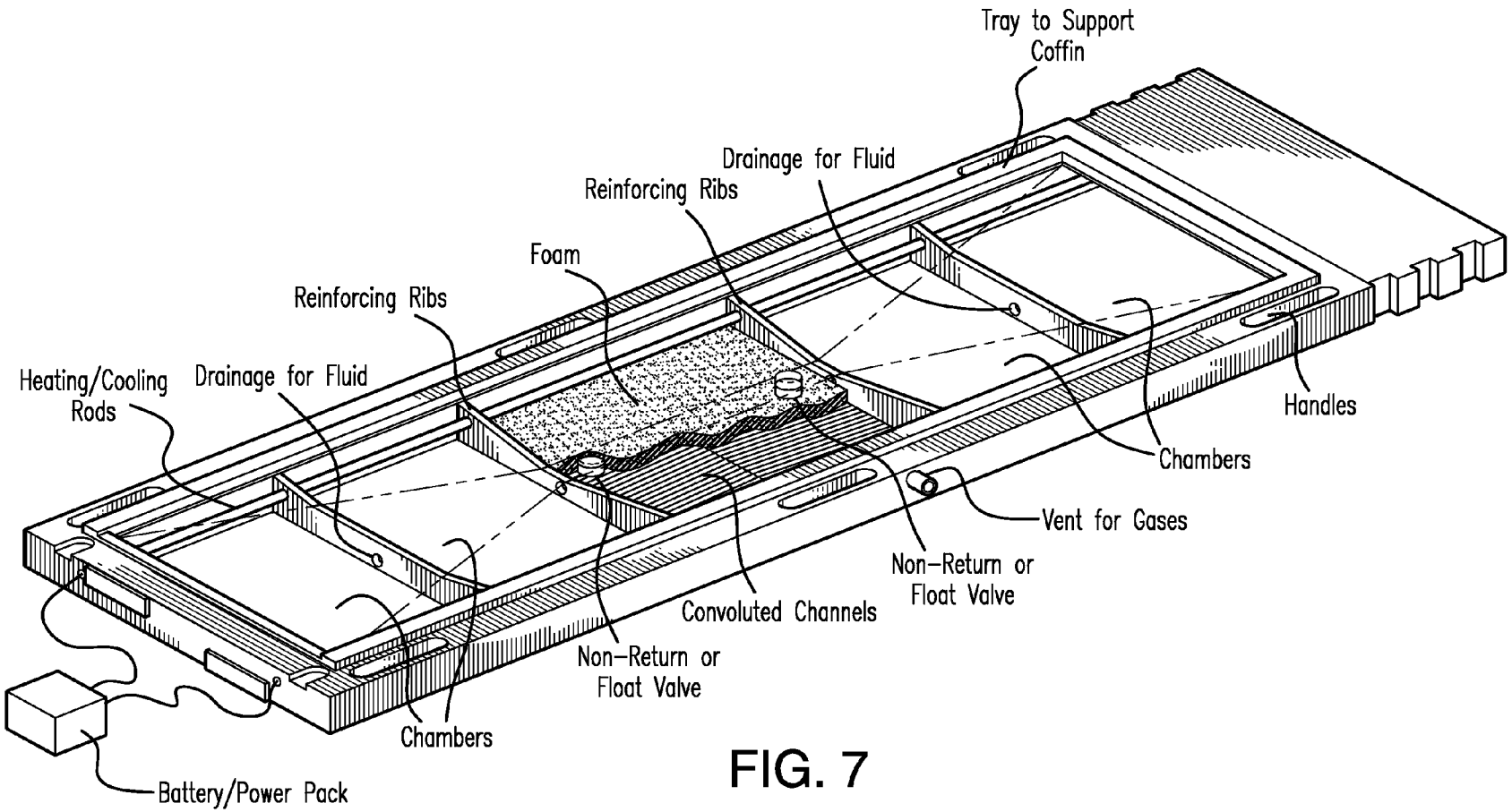
FIG. 7 shows an embodiment of the present invention.

The lower face 4 of the tray may be ribbed for strength. As shown in FIG. 3, the ribs 20 may define recesses or shaped formations that may be used for retaining objects, such as urns or decomposite material, if the tray is inverted.

A tray according to the present invention can be used to collect and neutralise or treat decomposition fluids and embalming fluids, avoiding the risk of groundwater contamination. The tray may form part of a grave lining system, such as that disclosed in EP 1783303, whereby the tray is located in a substantially sealed environment where the only fluids that can pass into the tray are those originating from within a coffin supported thereon. Thus the tray has sufficient capacity to collect and retain such fluids for an indefinite period. The tray may be provided with apertures, tongues, grooves or other formations to allow the tray to be interconnected with riser portions of the grave lining system.

The invention is not limited to the embodiments described herein but can be amended or modified without departing from the scope of the present invention.

The invention claimed is:

1. A coffin tray for placement within or beneath a coffin for collecting and/or treating decomposition fluids from a corpse, wherein said tray comprises a hollow body including an upper wall and a lower wall defining at least one closed chamber therebetween, said upper wall being provided with at least one drainage aperture through which fluid collected on an outer surface of the upper wall will pass into said at least one closed chamber to be retained and/or treated therein wherein the upper wall of the tray slopes downwardly from a peripheral region towards at least one collection region to guide fluids towards the at least one drainage aperture, the at least one drainage aperture being provided at a lowermost point of said at least one collection region.

2. The coffin tray as claimed in claim 1, wherein one or more reinforcing ribs are provided extending between the upper and lower walls to strengthen the tray.

3. The coffin tray as claimed in claim 2, wherein at least one of said reinforcing ribs divides the interior of the tray into two or more closed chambers, each chamber being communication with at least one drainage aperture in the upper wall of the tray.

4. The coffin tray as claimed in claim 3, wherein the upper wall of the tray is formed such that the separate drainage apertures are provided at different heights.

5. The coffin tray as claimed in claim 3, wherein each of said two or more chambers contains a separate neutralising and/or treatment agent.

6. The coffin tray as claimed in claim 1, wherein said at least one chamber is formed to define a convoluted channel or passageway through which fluids entering said chamber are constrained to flow.

7. The coffin tray as claimed in claim 1, wherein a raised lip is provided around or adjacent a peripheral edge of the upper wall of the tray to assist the collection of fluid thereon.

8. The coffin tray as claimed in claim 1, wherein said at least one said closed chamber contains at least one neutralising and/or treatment agent for neutralising and/or treating said fluids.

9. The coffin tray as claimed in claim 8, wherein said at least one neutralising and/or treatment agent comprising at least one of a fluid capable of neutralising formaldehyde embalming fluid.

10. The coffin tray as claimed in claim 8, wherein the tray contains an absorbent material.

11. The coffin tray as claimed in claim 1, wherein said at least one drainage aperture is provided with a non-return and/or float valve to allow fluid to pass into said closed chamber but prevent fluids and/or gases from escaping from said closed chamber through said drainage aperture.

12. The coffin tray as claimed in claim 1, wherein a pressure relief valve is provided for venting gases from said closed chamber when the gas pressure within the closed chamber exceeds the ambient pressure by more than a predetermined amount.

13. The coffin tray as claimed in claim 1, wherein the upper wall of the tray is provided with locating formations for locating the coffin thereon.

14. The coffin tray as claimed in claim 13, wherein said locating formations include fastening means and/or locking means for securing the coffin to the tray.

15. The coffin tray as claimed in claim 1, wherein apertures, slots or handles are provided on the tray, at or adjacent side regions of the tray, for receiving lifting straps to permit the tray, and the coffin located thereon, to be lowered into a grave.

16. The coffin tray as claimed in claim 1, wherein the tray is dimensioned to fit within the lower region of the coffin.

17. The coffin tray as claimed in claim 1, wherein the tray forms the base of the coffin.

18. The coffin tray as claimed in claim 17, wherein a cover is attachable to the base for enclosing the coffin upon the tray.

19. The coffin tray as claimed in claim 1, further comprising heating means for raising or controlling the temperature within the tray wherein said heating means comprise one or more elongate rods formed from a thermally conductive material extending through the tray to be connectable to a heat source and/or one or more conduits extending through said tray containing a heat transfer medium, said one or more conduits being connectable to a heat source.

20. The coffin tray as claimed in claim 19, wherein the tray incorporates temperature sensing means for controlling said heating means.

21. The coffin tray as claimed in claim 1, wherein the tray is provided with at least one drain or outlet from which fluid will escape following treatment within the tray.

* * * * *